US006659285B1

(12) United States Patent
Dixon

(10) Patent No.: US 6,659,285 B1
(45) Date of Patent: Dec. 9, 2003

(54) TOOL FOR SEPARATING COALS FROM ASH AND METHOD OF USE

(76) Inventor: William C. Dixon, 3300 Mill Creek Rd., Healdsburg, CA (US) 95448

( * ) Notice: Subject to any disclaimer, the term of this patent is extended or adjusted under 35 U.S.C. 154(b) by 212 days.

(21) Appl. No.: 10/035,984

(22) Filed: Dec. 24, 2001

(51) Int. Cl.[7] ..... B07B 1/00
(52) U.S. Cl. ..... 209/235; 126/244
(58) Field of Search ..... 209/233, 235, 209/417, 419; 126/242, 244; 294/55

(56) References Cited

U.S. PATENT DOCUMENTS 1,257,415 A * 2/1918 Smith ..... 209/419
4,305,376 A * 12/1981 Neugent ..... 126/242

* cited by examiner

*Primary Examiner*—Kenneth W. Noland
(74) *Attorney, Agent, or Firm*—Ted Masters

(57) ABSTRACT

A tool for separating coals from ash, includes and elongated body having a handle at one end and a plurality of substantially parallel spaced-apart first fingers longitudinally disposed along the body at an opposite second end. The first fingers form a curved shovel-like structure which outwardly projects substantially perpendicular to the body. The distal ends of the first fingers are connected by a cross member. A plurality of substantially parallel spaced-apart second fingers are longitudinally disposed along the body on the opposite side from the first fingers. The second fingers form a tapered rake configuration. The tool is used to (1) push a coal/ash mixture to one area of a fire box, (2) sift the coals from the ash, (3) flip the separated coals to a second area of the fire box, (4) rake coals from the coal/ash pile, and (5) drag coals from the top surface of the coal/ash pile.

21 Claims, 8 Drawing Sheets

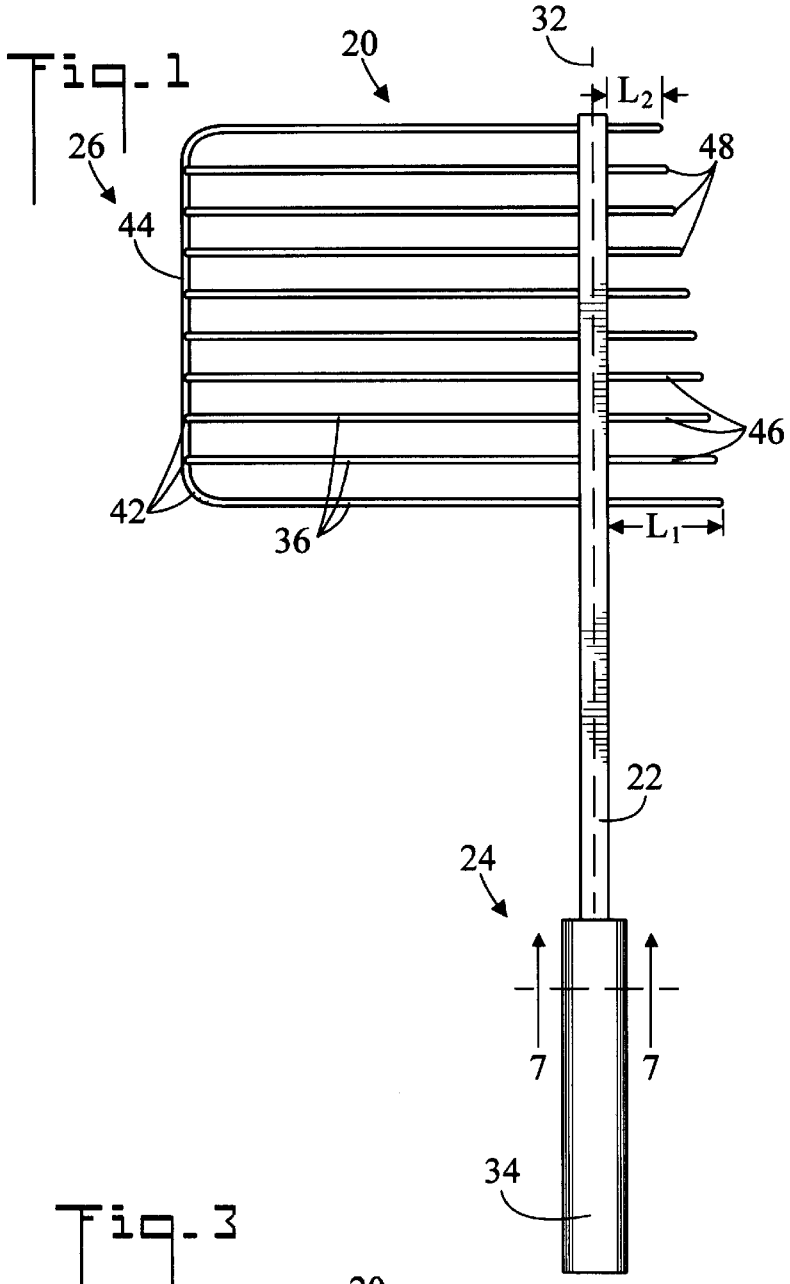
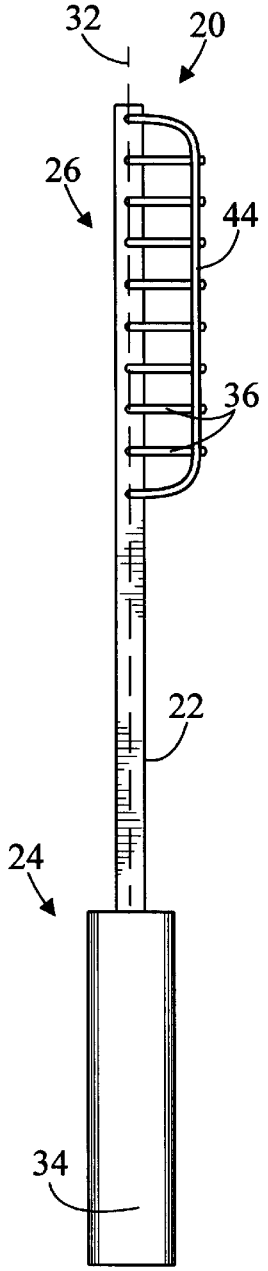
Fig. 2
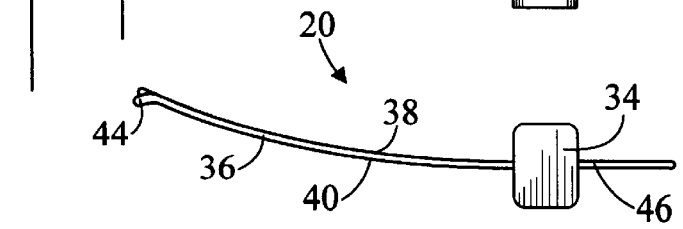

Fig. 4
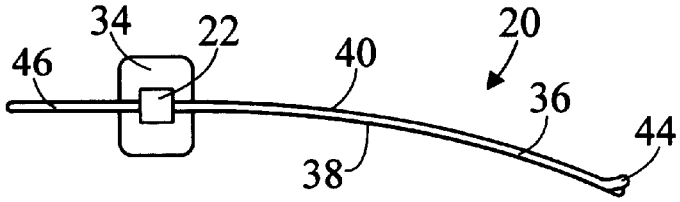
Fig. 5
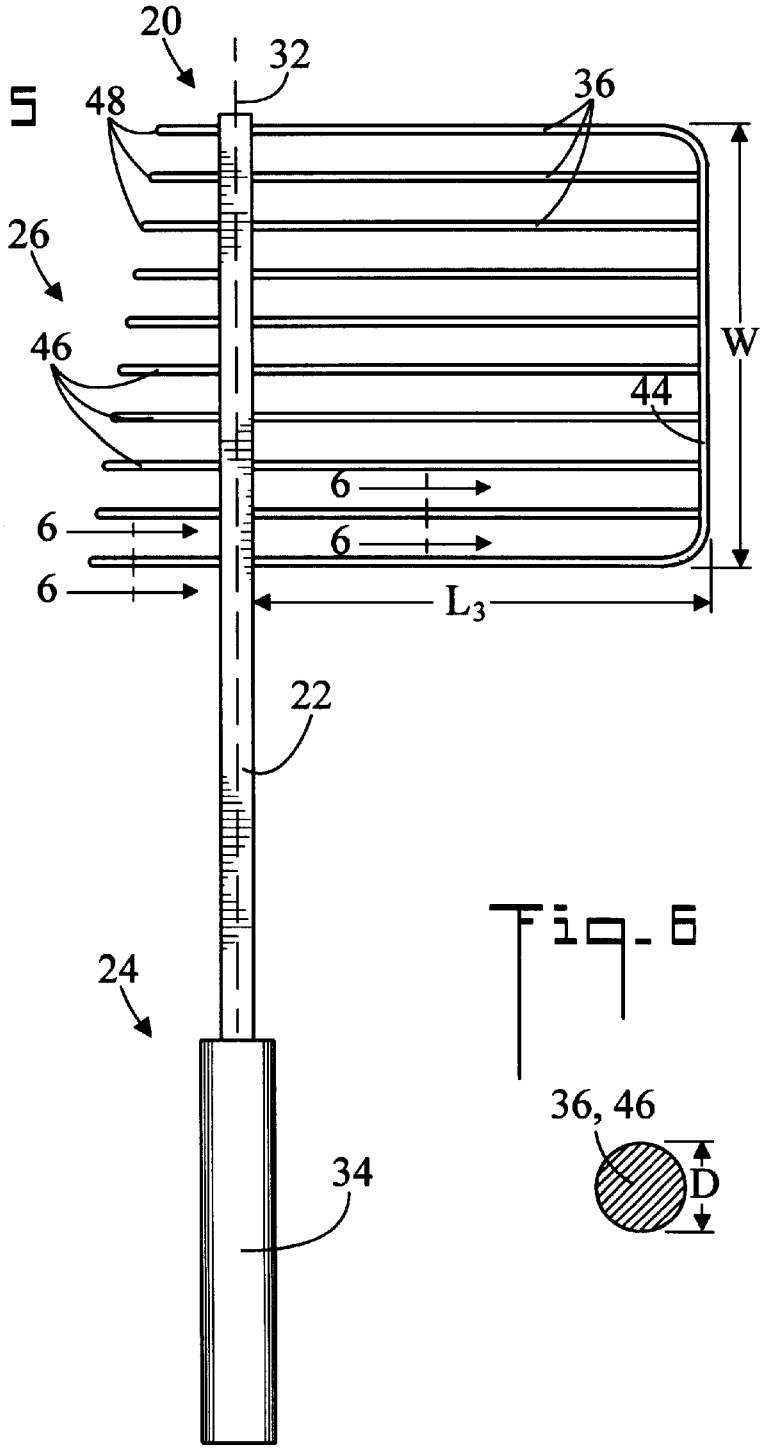
Fig. 6

TOOL FOR SEPARATING COALS FROM ASH AND METHOD OF USE

TECHNICAL FIELD

The present invention pertains generally to fireplaces, fireboxes, wood stoves and the like, and more particularly to an improved tool for separating hot coals from ash so that a new fire can be started in a rapid and efficient manner.

BACKGROUND OF THE INVENTION

With rising energy costs, a renewed interest exists in heating buildings by burning wood, coal and other solid fuels. Concurrently, efforts continue to reduce particulate emissions and gaseous products of incomplete combustion in order to reduce air pollution. The usual pattern of home heating allows a fire to burn down to the level of ashes and coals either overnight, or during the day, at which time it is desirable to restart the fire promptly. One way to do this is to simply place logs on the residual bed of mixed coals and ashes. However most fireboxes perform less efficiently as ashes accumulate in the bottom, and eventually, the ash/coal mixture must be removed. The mixture must either be removed hot, which presents a disposal problem since the heat wafts considerable ash into the room and the mixture serves as an ignition source when discarded, or the fire must be allowed to die down further, which requires a period of time during which no heat is being provided.

Then in order to start a new fire, one must use paper or a similar low heat fuel, followed by kindling, and finally by the main fuel, which is usually logs, pellets or coal. Ten to twenty minutes of effort and close attention, plus a large amount of prepared paper and kindling, with a corresponding large amount of poor combustion is needed to use this method. The present invention allows a way to separate the still usable coals from the ashes, so that the ashes can be discarded. The coals can then be used to promptly restart a new fire without the need for paper, kindling or extensive time and attention.

Devices for handling the contents of furnaces and for separating coals from ash are well known in the art. For example, U.S. Pat. No. 72,294 shows a cinder shovel. The shovel has a plurality of teeth and can be utilized to transport coal without spilling.

U.S. Pat. No. 226,351 illustrates a shovel or scoop for handling potatoes, corn, coal, or other materials which are mixed with dust or dirt. Parallel wires serve as a screen to separate the refuse from the objects.

U.S. Pat. No. 229,119 discloses a wire cinder shovel for separating coke and cinders from coal-ashes. The device consists of a shovel having a series of wires fastened by both ends to the handle and an angular wire fastened near a forward portion which serves as a brace.

U.S. Pat. No. 1,257,415 comprises a sifting shovel formed of rigid wire. The shovel has a front crosspiece.

These existing separator designs were designed primarily for furnaces, where considerable space was available and a push-pull shoveling motion was possible. However, these devices could not function properly in smaller stoves and fireboxes.

Alternatively, devices shaped like a common garden rake could be used to separate ash and coal from front to back in the firebox, but even then, they would only work if the depth of the ash-coal mixture is within the range of the rake tines. Furthermore, use of a rake makes it difficult to manipulate the contents forward and back in the confines of a wood stove.

One shovel-type device more specifically designed for woodstoves is shown in U.S. Pat. No. 4,305,376 provides a screening and separating action while it removes the ashes from a fire, but it will not operate tightly behind the front lower lip of modern wood stoves, it contains moving parts, and it is designed to replace the standard fireplace shovel.

U.S. Pat. No. Des. 285,831 shows a fireplace coal and ash separator which has an elongated shaft, a handle, and a pan having a plurality of slots.

U.S. Pat. No. Des. 420,735 describes a fireplace ash and coal separator which has an elongated shaft, a handle, and a shovel portion which has a plurality of fingers connected by a cross member.

One further problem exists that is not addressed by the prior art. If ash and coal separation is to be done within a firebox, it is necessary to first move all the ash-coal mixture to one part of the box before separation, in order to have a clear area in which to deposit the separated coals. If this clear area is not provided, then one must dump the separated coals back onto the ash-coal mixture. Therefore, each scoop merely causes a serial dilution of ash content and does not actually result in complete separation.

Accordingly, there is a need for a simple ash/coal separation tool that supplements existing fireplace or woodstove tool functions, has the versatility and reliability of a tool with no moving parts, provides access to the ash/coal mixture behind the front lip of the firebox, and allows the entire ash/coal mixture to be moved to one part of the firebox, leaving clear area to deposit the separated coals.

SUMMARY OF THE INVENTION

The present invention is directed to a tool for separating coal from ash and comprises a rigid shaft with a handle at one end and an array of parallel, curved, rigid, round, wire-like elements comprising fingers or tines mounted perpendicularly to each side of the shaft at the other end. The parallel fingers provide the pushing and sifting/separating action. On one side of the shaft, the lengthiest of the parallel fingers have their distal ends bonded to a continuous element running perpendicular to the parallel fingers. On the opposite side of the shaft, parallel fingers protrude that are shorter, and arranged in such a fashion as to serve as a rake.

The present invention is specifically tailored to use in the restricted space of a wood stove or fireplace, where the forward scooping action does not work well.

The right angle arrangement of the scoop utilizes the powerful and controllable motion of the human forearm that is called supination. This action, which for a right-handed operator results in clockwise rotation of the tool and the forearm, is the same motion that is used to tighten screws with a screwdriver and adjust controls on machinery. It is a much easier and more natural motion than shoveling for work in small spaces.

The right angle arrangement of the scoop also allows the scoop to reach the ash/coal mixture immediately behind the front lip of the wood stove or fireplace firebox. This is an area inaccessible to a straight shovel.

The right angle arrangement of the scoop formed by the fingers also allows for use as a "pusher" to quickly push the ash/coal mixture to the side, and then sift, separate and transport the coals to the opposite side. Formation of an ash/coal pile with an adjacent clear area, is a key requirement for efficient ahs/coal separation within a firebox. Without a clear area in which to deposit the separated coals, each iteration of the sifting process merely dilutes the ashes and does not achieve good separation. A shovel-type device has a fundamental limitation in being unable to easily move an ash/coal mixture into a pile.

The use of round, wire-like parallel tines or fingers in the scoop makes the tool partially self-cleaning. Very little ash sticks to the round elements, as opposed to elements with flat surfaces that tend to accumulate ash. Further, the coals tend not to become trapped between the round parallel fingers as they do with flat, square, rectangular or crisscrossed elements.

The use of a continuous round, wire-like leading edge provides smoother sliding action when entering the ash/coal mixture than does an open ended (fork-like) arrangement. The continuous leading edge is light enough that the entire scoop portion still vibrates a bit when tapped against the inside of the firebox, and the vibration is a useful feature to dislodge the rare coal that does become wedged between fingers, or to shake any adherent ash from the tool.

The fingers of progressively tapering length on the opposite side of the main shaft are designed to serve as a rake. Because of the front lip of wood stoves, and because of the natural tendency to hold a fireplace tool so that it angles down into a fireplace even if there is no lip, the tapering tines allow the main shaft to be held at a usable angle and still contact the floor of the firebox during a sideways raking action.

Advantages of the Invention:

1. The tool of the present invention is a simple mechanical tool with no moving parts.
2. This tool is reliable
3. This tool and technique restart a fire in two to five minutes as opposed to the ten to twenty minutes required with the conventional cleaning, paper and kindling method.
4. The fire which is started is much hotter much sooner than a fire started with the paper and kindling method.
5. This tool and technique do not require the preparation or storage of paper and kindling.
6. Less pollution is generated since low-heat paper and kindling starts are avoided.
7. The volume and heat content of the discarded ash material is reduced, making disposal less hazardous.
8. This tool and technique save and put to use the heat content of the coals which would otherwise be discarded.
9. This tool and technique make use of the powerful supination action of the human forearm, a motion more controllable than axial pushing or other movements.
10. The operation is one-handed; it does not require the function of the opposite upper limb.
11. This tool and technique supplement the existing standard fireplace tool set. No existing tool is rendered obsolete, and this tool easily hangs on most fireplace tool racks.
12. As shown below, this tool and technique allow the lower frontal area of the firebox to be easily cleaned. This area is not readily accessible to shovel-type implements.
13. The curved, parallel and properly spaced arrangement of the operating fingers allows the tool to function as both a pusher and a sifter.
14. The long rigid fingers, when tapped against the inside wall of the firebox, vibrate slightly and produce a self-cleaning action which shakes loose particles off of the elements.
15. The rounded nature of the parallel fingers reduces the likelihood of a coal becoming wedged between the fingers. Any coal that does become stuck is quickly dislodged with a tap of the tool against the inside of the firebox.
16. The sifting technique leaves a small amount of smaller material on top of the ash coal pile. The perpendicular member which connects the distal ends of the parallel fingers together, by virtue of being mounted beneath the parallel finger tips, serves a dragging function and can pull this smaller material from the top of the ash coal pile.

In accordance with a preferred embodiment of the invention, a tool for separating coals from ash includes an elongated shaft-like body having a first end, an opposite second end, and a longitudinal axis. A handle is disposed at the first end. A plurality of substantially parallel spaced-apart first fingers are longitudinally disposed along the body at the second end. The first fingers outwardly project from the body substantially perpendicular to the longitudinal axis. The first fingers are curved having a concave side and an opposite convex side. Each finger has a distal end, wherein the distal ends of all the fingers are connected by a cross member.

In accordance with an important aspect of the invention, the cross member is disposed on the convex side of the first fingers.

In accordance with another preferred embodiment of the invention, a plurality of substantially parallel spaced-apart second fingers are also longitudinally disposed along the body at the second end. The second fingers outwardly projecting from body substantially perpendicular to longitudinal axis in an opposite direction from the first fingers. The second fingers each having a different length, wherein the second finger closest to the first end of the elongated body is the longest, and the second finger closest to the second end of the elongated body is the shortest, and the length of each intervening second finger being selected so as to create a substantially tapered rake arrangement.

In accordance with an important feature of the invention, the handle has a cross section having a major axis and a perpendicular minor axis, the major axis longer than the minor axis.

In accordance with another important aspect of the invention, the cross section of the handle is one of substantially rectangular and substantially oval.

In accordance with another important feature of the invention, the major axis forming an angle of between about 70° and about 90° with the first fingers.

In accordance with an important aspect of the invention, the first and second fingers having a substantially circular cross section.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is a top plan view of a tool for separating coals from ash in accordance with the present invention;

FIG. 2 is a side elevation view;

FIG. 3 is an end elevation view;

FIG. 4 is an opposite end elevation view;

FIG. 5 is a bottom plan view;

FIG. 6 is an enlarged cross sectional view along the line 6—6 of FIG. 5;

DETAILED DESCRIPTION OF THE INVENTION

Figure 7:
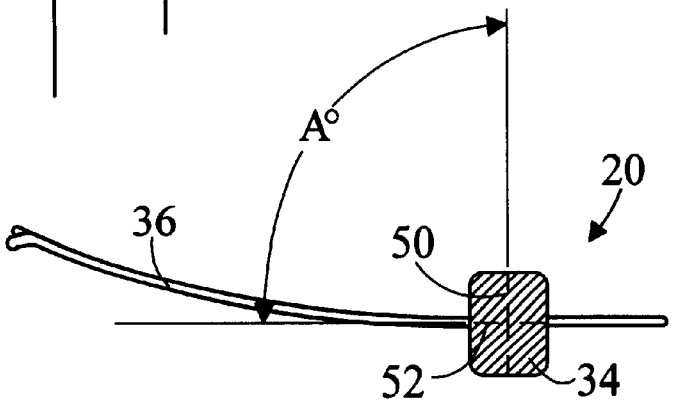
FIG. 7 is a cross sectional view of a handle along the line 7—7 of FIG. 1.

Referring initially to FIGS. 1–5, there are illustrated top plan, side elevation, end elevation, opposite end elevation, and bottom plan views respectively of a tool for separating coals from ash in accordance with the present invention, generally designated as 20. Tool 20 includes an elongated body 22 having a first end 24, an opposite second end 26, and a longitudinal axis 32. In a preferred embodiment, elongated body 22 has a substantially rectangular cross section. A handle 34 is disposed at first end 24. A plurality of substantially parallel spaced-apart first fingers 36 are longitudinally disposed along body 22 at second end 26. First fingers 36 outwardly projecting from body 22 substantially perpendicular to longitudinal axis 32. First fingers 36 are curved and have a concave side 38 and an opposite convex side 40. Each first finger 36 has a distal end 42, and the distal ends 42 of all first fingers 36 are connected by a cross member 44 which is disposed substantially parallel to longitudinal axis 32. Cross member 44 is disposed on convex side 40 of first fingers 36. In the shown embodiment, cross member 44 comprises a perpendicular extension of the two outside first fingers 36. In a preferred embodiment, plurality of spaced-apart first fingers 36 define a total width W of between about six inches and about seven inches, and a third length $L_3$ of between about seven inches and about eight inches.

Tool 20 further includes a plurality of substantially parallel spaced-apart second fingers 46 also longitudinally disposed along body 22 at second end 26. Second fingers 46 outwardly project from body 22 substantially perpendicular to longitudinal axis 32, in a substantially opposite direction from first fingers 36. Second fingers 46 each have a different length, wherein the second finger 46 closest to first end 24 of elongated body 22 is the longest, and the second finger 46 closest to second end 26 of elongated body 22 is the shortest, and the length of each intervening second finger 46 is selected so as to create a substantially tapered arrangement. In the shown preferred embodiment, second finger 46 closest to first end 24 has a first length $L_1$, and second finger 46 closest to second end 26 has a second length $L_2$, wherein first length $L_1$ is at least twice second length $L_2$. Second fingers 46 each have a distal end 48, the distal ends 48 not being connected to each other, thereby forming a tapered rake configuration. In a preferred embodiment, the plurality of second fingers 46 is equal to the plurality of first fingers 36, and each second finger 46 is longitudinally aligned with a corresponding first finger 36. Also in a preferred embodiment of the invention, the plurality of first 36 and second fingers 46 is either eight, nine, or ten. Tool 20 shown in FIGS. 1–5 is designed for use be a right handed person. It may be appreciated that the first 36 and second 46 fingers may be reversed for a left handed person.

Referring now to FIG. 6, there is illustrated an enlarged cross sectional view along the line 6—6 of FIG. 5. In a preferred embodiment, first 36 and second 46 fingers have a substantially circular cross section which has a diameter D of about one-eighth of an inch.

Figure 8:
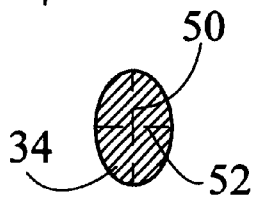
FIG. 8 is a cross sectional view of an oval handle embodiment.

FIG. 7 is a cross sectional view of handle 34 along the line 7—7 of FIG. 1. Handle 34 has a cross section having a major axis 50 and a perpendicular minor axis 52, the major axis 50 being longer than the minor axis 52. Having axis 50 longer than axis 52 better accommodates a grasping hand, and therefore assists in the process of flipping the coals off of tool 20 (refer to FIG. 15). Also referring to FIG. 8, in a preferred embodiment the cross section of handle 34 is one of substantially rectangular and substantially oval. Major axis 50 forms and angle A with first fingers 36. In the shown embodiment, angle A is about 90°.

Figure 9:
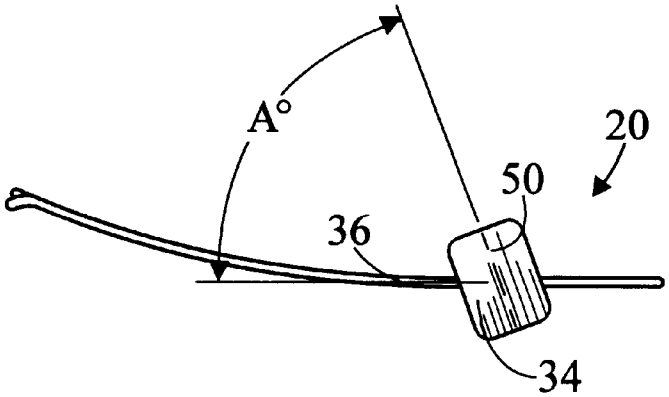
FIG. 9 is an end elevation view showing a second handle orientation.

FIG. 9 is an end elevation view showing a second handle 34 orientation. In this embodiment major axis 50 forms an angle A of about 70° with first fingers 36. This arrangement is useful in imparting a maximum velocity to coals as they are flipped off of tool 20 (also refer to FIG. 15 and the discussion pertaining thereto). Also referring to FIG. 7, an angle A of between about 70° and about 90° is preferred.

Figure 10:
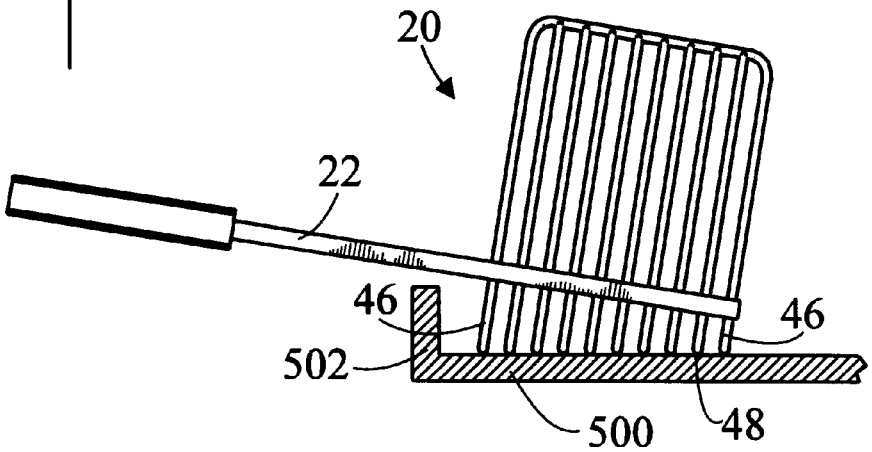
FIG. 10 is a reduced top plan view of the tool being utilized as a rake in a firebox.

FIG. 10 is a reduced top plan view of tool 20 being utilized as a rake in a firebox 500. Because second fingers 46 form a tapered configuration, tool 20 may be placed into the firebox 500 with the distal ends 48 of second fingers 46 all residing on the floor of the firebox 500, and body 22 not abutting lip 502 of firebox 500.

Figure 11:
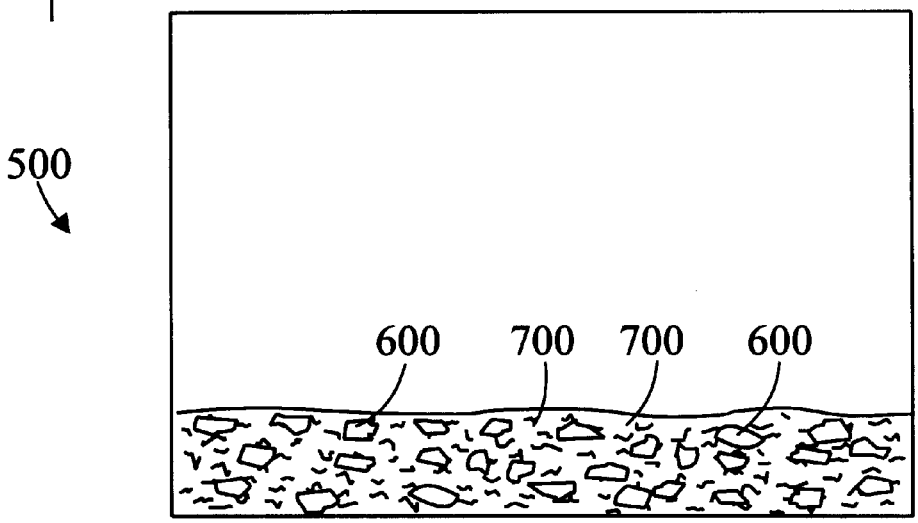
FIG. 11 is a reduced elevation view of coals and ash in a firebox.

FIG. 11 is a reduced elevation view of coals 600 and ash 700 in a firebox 500. After a fire burns down, the fireplace or firebox 500 will contain a mixture of coals 600 and ashes 700. The larger, solid coals 600 will persist for many hours if the fire's air intake has been reduced as is customary during overnight or unattended periods.

Figure 12:
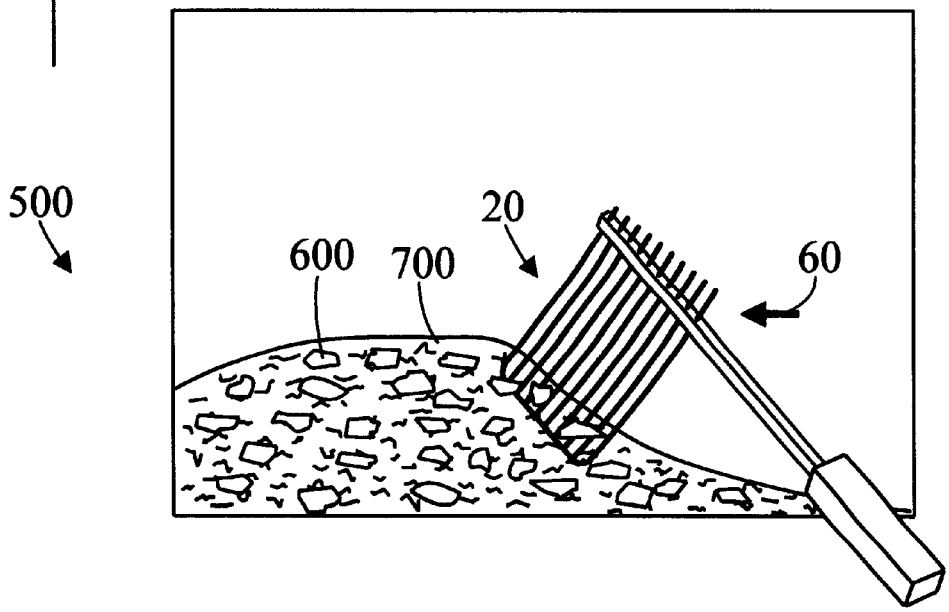
FIG. 12 is a reduced elevation view of the tool of the present invention being utilized to push the coals and ash into a pile.

FIG. 12 is a reduced elevation view of the tool 20 of the present invention being utilized to push the coals 600 and ash 700 into a pile. Tool 20 is used to sweep (push) all of the ash/coal mixture in direction 60 to the left side of the firebox 500 (assuming a right handed operator).

Figure 13:
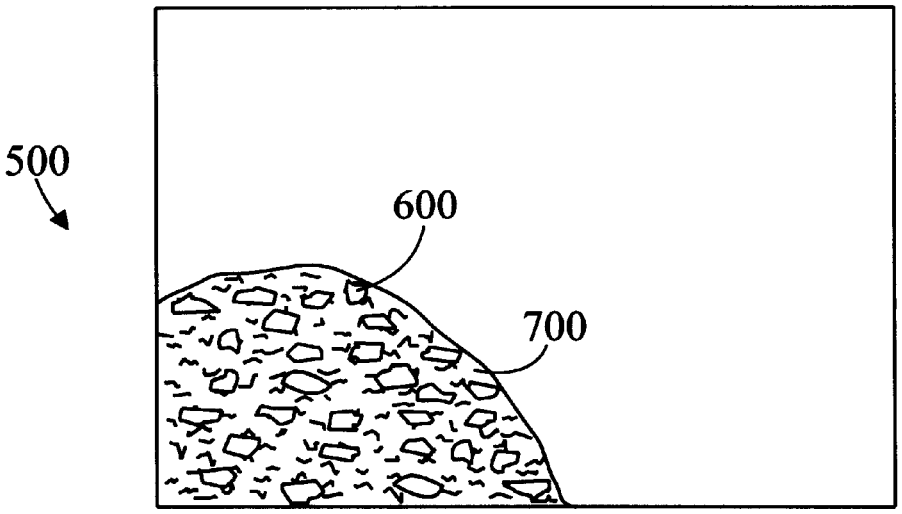
FIG. 13 is a reduced elevation view of the pile created by the pushing action of the tool, and a clear area in which the coals will be deposited.

FIG. 13 is a reduced elevation view of the pile of coal 600 and ash 700 created by the pushing action of tool 20, and a clear area in which the coals 600 will ultimately be deposited.

Figure 14:
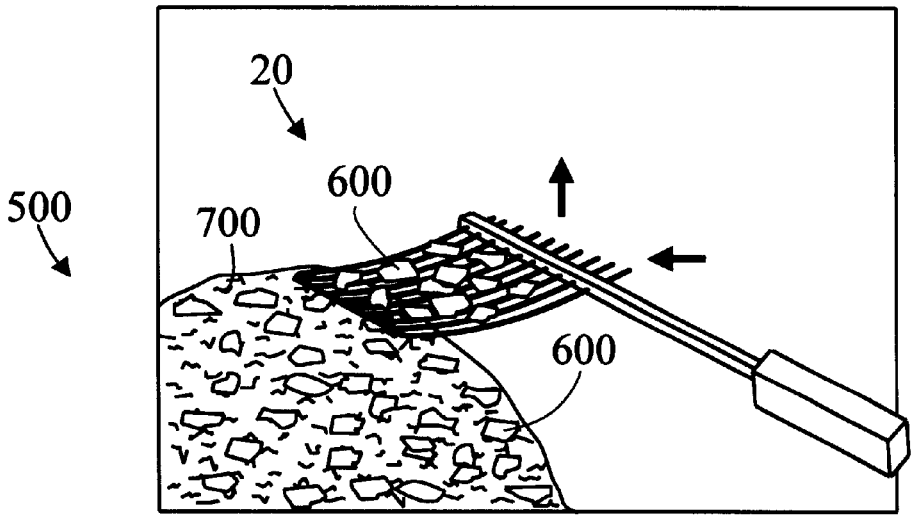
FIG. 14 is a reduced elevation view of the tool being utilized to remove coals from the pile.

FIG. 14 is a reduced elevation view of tool 20 being utilized to remove coals 600 from the pile of coal 600 and ash 700. Tool 20 is inserted more or less horizontally into the ash/coal pile, and with a gentle lift and shake, the coals 600 are lifted up and out of the pile.

Figure 15:
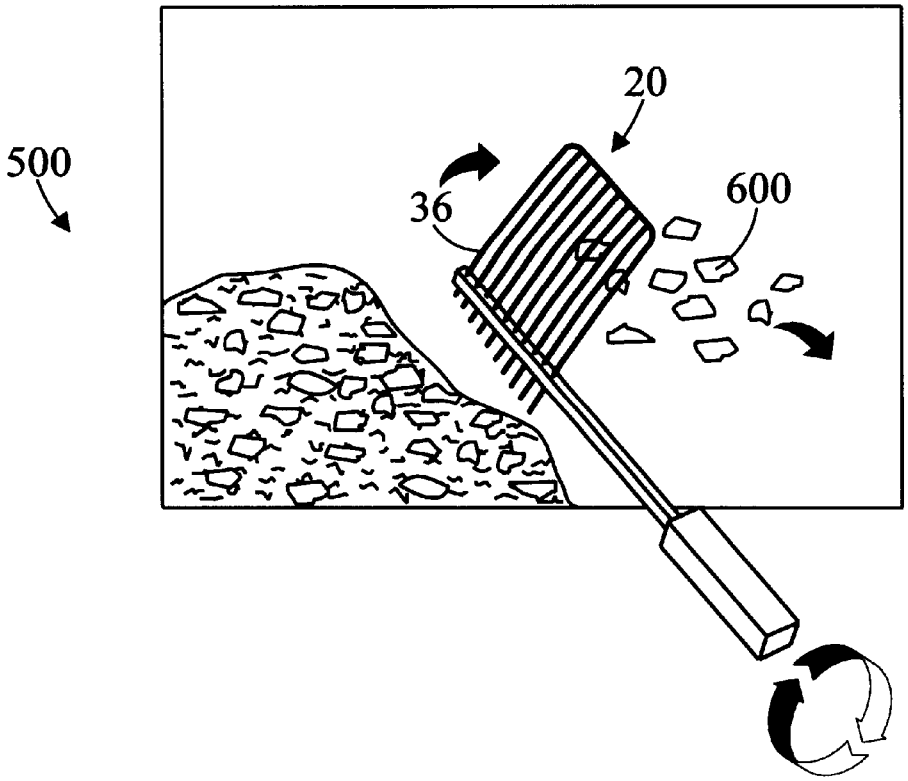
FIG. 15 is a reduced elevation view of the tool being utilized to flip the coals into the clear area.

FIG. 15 is a reduced elevation view of tool 20 being utilized to flip the coals 600 into the clear area of firebox 500. Tool 20 is then rotated clockwise (for a right handed operator). This flipping action deposits the coals 600 in the right side of the firebox, leaving the ash 700 on the left. Also, a user does not have to rotate the first fingers 36 a full ninety degrees about its handle axis 32 in order to move separated coals 600 over to the clear spot. A quick twist of about 30° degrees, and the coals 600 are tossed neatly over to the empty side of the firebox 500. The coals seem to be partially launched, and to partially slide down the curved incline of first fingers 36.

The removal and flipping process of FIGS. 14 and 15 is repeated a few times to separate most of the coals 600. The rake (second fingers 46) is then used as necessary for left over coals 600. As a result of the sifting technique, there will also be a few smaller coals 600 that remain near the top of the primarily ash 700 pile. These can be moved to the right by using cross member 44 on the underside of the tool 20 to laterally drag those surface coals 600 to the coal 600 pile (refer also to FIGS. 19 and 20).

Figure 16:
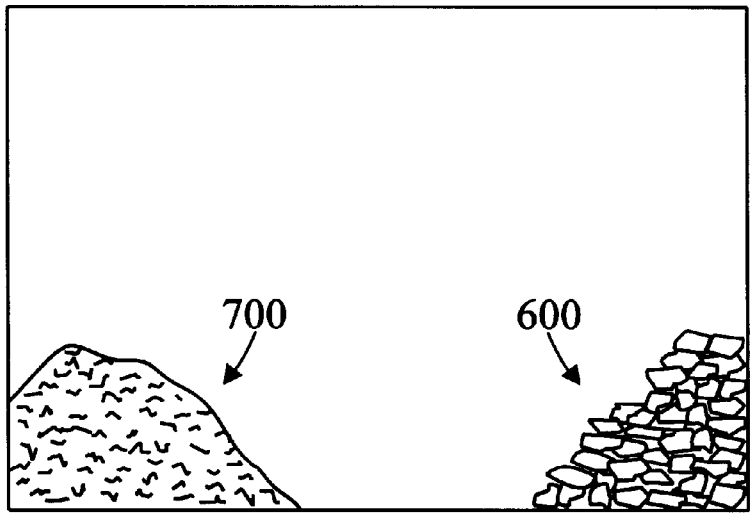
FIG. 16 is a reduced elevation view of the coals separated from the ash.

FIG. 16 is a reduced elevation view of the coals 600 separated from the ash 700. The ashes 700 are then removed and discarded by means of any standard fireplace shovel or device.

Figure 17:
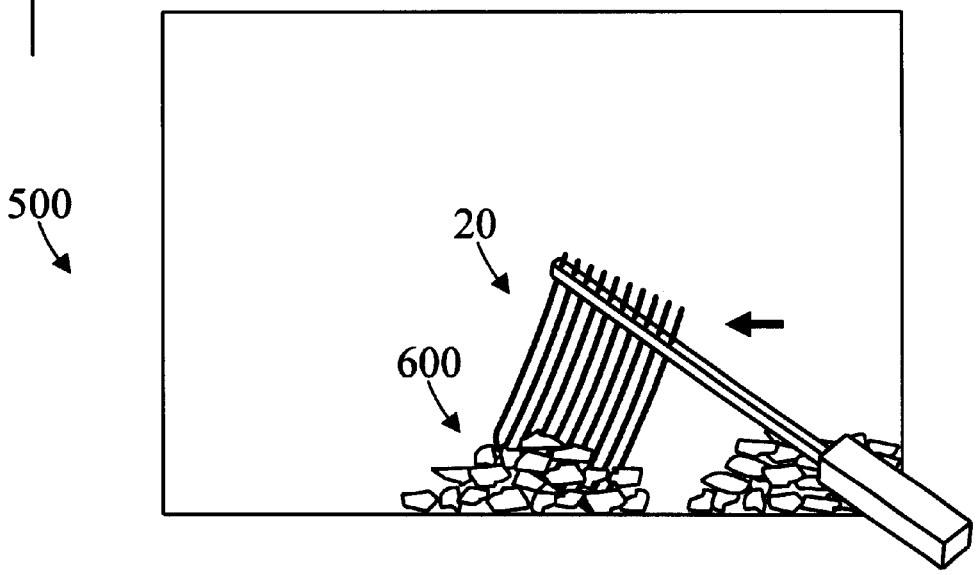
FIG. 17 is a reduced elevation view of the tool being utilized to push the coals into the center of the firebox.

FIG. 17 is a reduced elevation view of tool 20 being utilized to push the coals 600 into the center of the firebox 500.

Figure 18:
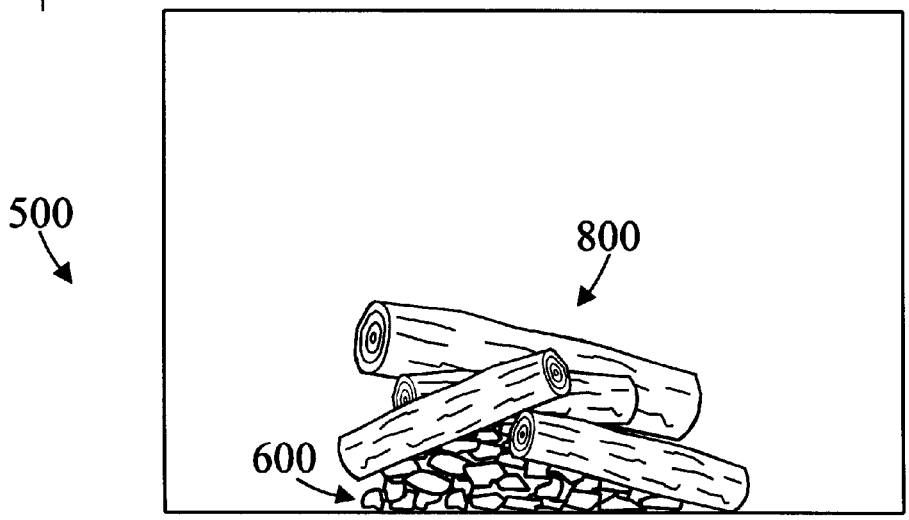
FIG. 18 is a reduced elevation view of unburned wood placed upon the coals.

FIG. 18 is a reduced elevation view of unburned wood 800 placed upon the coals 600. The hot coals 600 will then restart the fire directly without the need for paper or kindling, by placing the solid fuel directly on top of them.

Figure 19:
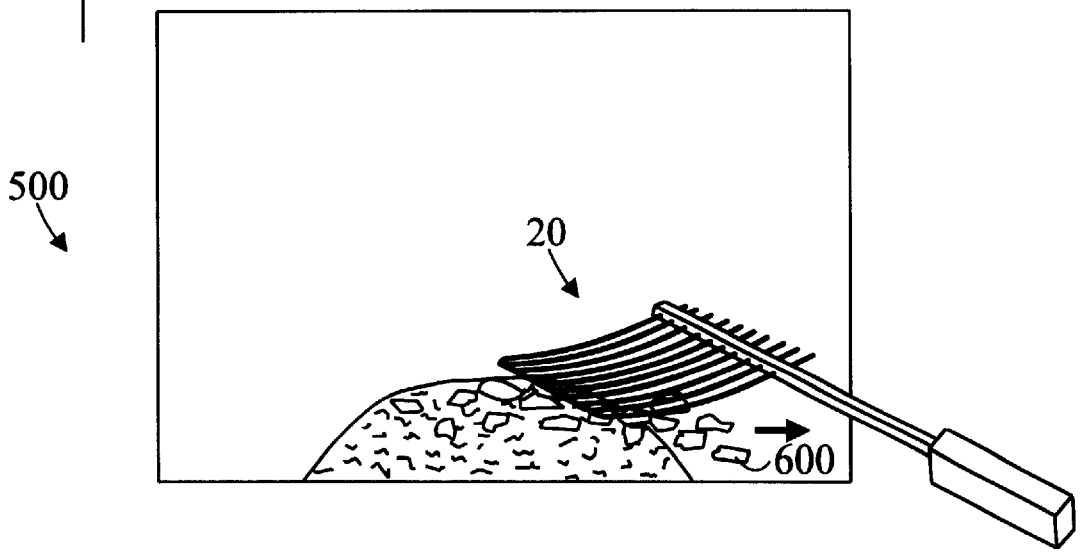
FIG. 19 is a reduced elevation view of the tool being utilized to drag surface coals from the pile of coals and ash; and, FIG. 20 is a side elevation view of a cross member of the tool being utilized to drag surface coals from the pile of coals and ash.

FIG. 19 is a reduced elevation view of tool 20 being utilized to drag coals 600 from the pile of coals 600 and ash 700.

Figure 20:
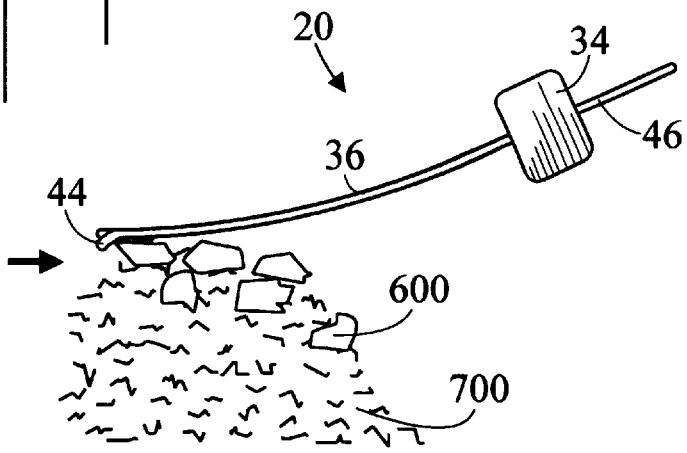

FIG. 20 is a side elevation view of the cross member 44 of tool 20 being utilized to drag coals 600 from the pile of coals 600 and ash 700. The way that the cross member 44 lies below the first fingers 36 allows it to catch and drag the finer coals 600 to the side.

In terms of use, a method for separating coals 600 from ash 700, comprising:

(1) providing a pile of coals 600 mixed with ash 700 residing in a firebox 500;

(2) providing a tool 20 for separating the coals 600 from the ash 700, the tool 20 having:
- an elongated body 22 having a first end 24, an opposite second end 26, and a longitudinal axis 32;
- a handle 34 disposed at the first end 24;
- a plurality of substantially parallel spaced-apart first fingers 36 longitudinally disposed along the body 22 at the second end 26;
- the first fingers 36 outwardly projecting from the body 22 substantially perpendicular to the body 22;
- the first fingers 36 being curved and having a concave side 38 and an opposite convex side 40;
- each first finger 36 having a distal end 42; and,
- the distal ends 42 of all the first fingers 36 connected by a cross member 44, the cross member 44 disposed substantially parallel to the longitudinal axis 32;

(3) grasping the handle 34;

(4) using the first fingers 36 to push the pile of coal 600 and ash 700 to a first area of the firebox 500;

(5) inserting the first fingers 36 concave side 38 up into the pile;

(6) removing the first fingers 36 from the pile so that a portion of the coals 600 reside on the concave side 38;

(7) in a supinating action rotating the handle 34 about the longitudinal axis 32 so that the portion of coals 600 are flipped to a second area of the firebox 500; and, (8) repeating steps (5) through (7) until the coals 600 have been separated from the ash 700.

The method further including:

in step (7), the rotation being at least about 30°.

The method further including:

(9) as required, using cross member 44 to drag surface coals 600 from the pile.

The method further including:

the tool 20 for separating the coals 600 from ash 700 further including:
- a plurality of substantially parallel spaced-apart second fingers 46 longitudinally disposed along the body 22 at the second end 26;
- said second fingers outwardly projecting from the body substantially perpendicular to the body;
- the second fingers 46 outwardly projecting from the body 22 in a substantially opposite direction from the first fingers 36; and,
- the second fingers each having a different length, wherein the second finger 46 closest to the first end 24 of the elongated body 22 is the longest, and the second finger 46 closest to the second end 26 of the elongated body 22 is the shortest, and the length of each intervening second finger 46 being selected so as to create a substantially tapered arrangement; and, (9) as required, using the second fingers 46 in a raking motion to ensure that all the coals 600 reside in the second area of the firebox 500.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A tool for separating coals from ash, comprising:

an elongated body having a first end, an opposite second end, and a longitudinal axis;

a handle disposed at said first end;

a plurality of substantially parallel spaced-apart first fingers longitudinally disposed along said body at said second end;

said first fingers outwardly projecting from said body substantially perpendicular to said longitudinal axis;

said first fingers being curved and having a concave side and an opposite convex side;

each said first finger having a distal end; and, said distal ends of all said first fingers connected by a cross member, said cross member disposed substantially parallel to said longitudinal axis.

2. A tool according to claim 1, further including:

said cross member disposed on said convex side of said first fingers.

3. A tool according to claim 1, further including:

a plurality of substantially parallel spaced-apart second fingers longitudinally disposed along said body at said second end;

said second fingers outwardly projecting from said body substantially perpendicular to said longitudinal axis;

said second fingers outwardly projecting from said body in a substantially opposite direction from said first fingers; and, said second fingers each having a different length, wherein said second finger closest to said first end of said body is the longest, and said second finger closest to said second end of said body is the shortest, and the length of each intervening second finger being selected so as to create a substantially tapered arrangement.

4. A tool according to claim 3, further including:

said second finger closest to said first end having a first length, and said second finger closest to said second end having a second length; and, said first length being at least twice said second length.

5. A tool according to claim 3, further including:

each said second finger having a distal end, said distal ends not connected to each other.

6. A tool according to claim 3, further including:

said plurality of second fingers being equal to said plurality of first fingers; and, each said second finger longitudinally aligned with a corresponding said first finger.

7. A tool according to claim 6, further including:

said plurality of first and second fingers being one of eight, nine, and ten.

8. A tool according to claim 1, further including:

said handle having a cross section having a major axis and a perpendicular minor axis, said major axis longer than said minor axis.

9. A tool according to claim 8, further including:

said cross section being one of substantially rectangular and substantially oval.

10. A tool according to claim 8, further including:

said major axis forming an angle of between about 70° and about 90° with said first fingers.

11. A tool according to claim 1, further including:

said first and second fingers having a substantially circular cross section.

12. A tool according to claim 11, further including:

said cross section having a diameter of about one-eighth of an inch.

13. A tool according to claim 1, further including:

said plurality of spaced-apart first fingers defining a width of between about six inches and about seven inches.

14. A tool according to claim 1, further including:

said plurality of spaced-apart first fingers having a third length of between about seven inches and about eight inches.

15. A tool according to claim 1, further including said body having a substantially rectangular cross section.

16. A tool according to claim 1, further including:

said cross member disposed on said convex side of said first fingers;

a plurality of substantially parallel spaced-apart second fingers longitudinally disposed along said body at said second end;

said second fingers outwardly projecting from said body substantially perpendicular to said longitudinal axis;

said second fingers outwardly projecting from said body in a substantially opposite direction from said first fingers;

said second fingers each having a different length, wherein said second finger closest to said first end of said body is the longest, and said second finger closest to said second end of said body is the shortest, and the length of each intervening second finger being selected so as to create a substantially tapered arrangement said plurality of second fingers being equal to said plurality of first fingers;

each said second finger longitudinally aligned with a corresponding said first finger;

said handle having a cross section having a major axis and a perpendicular minor axis, said major axis longer than said minor axis;

said first and second fingers having a substantially circular cross section;

said second finger closest to said first end having a first length, and said second finger closest to said second end having a second length;

said first length being at least twice said second length; and, each said second finger having a distal end, said distal ends not connected to each other.

17. A tool for separating coals from ash, comprising:

an elongated body having a first end, an opposite second end, and a longitudinal axis;

a handle disposed at said first end;

a plurality of substantially parallel spaced-apart first fingers longitudinally disposed along said body at said second end;

said first fingers outwardly projecting from said body substantially perpendicular to said longitudinal axis;

said first fingers being curved and having a concave side and an opposite convex side;

each said first finger having a distal end; and, said distal ends of all said first fingers connected by a cross member, said cross member disposed substantially parallel to said longitudinal axis;

said cross member disposed on said convex side of said first fingers;

a plurality of substantially parallel spaced-apart second fingers longitudinally disposed along said body at said second end;

said second fingers outwardly projecting from said body substantially perpendicular to said longitudinal axis;

said second fingers outwardly projecting from said body in a substantially opposite direction from said first fingers;

said second fingers each having a different length, wherein said second finger closest to said first end of said body is the longest, and said second finger closest to said second end of said body is the shortest, and the length of each intervening second finger being selected so as to create a substantially tapered arrangement; and, each said second finger having a distal end, said distal ends not connected to each other.

18. A method for separating coals from ash, comprising:

(1) providing a pile of coals and ash residing in a firebox;

(2) providing a tool for separating the coals from the ash, said tool having:

an elongated body having a first end, an opposite second end, and a longitudinal axis;

a handle disposed at said first end;

a plurality of substantially parallel spaced-apart first fingers longitudinally disposed along said body at said second end;

said first fingers outwardly projecting from said body substantially perpendicular to said body;

said first fingers being curved and having a concave side and an opposite convex side;

each said first finger having a distal end; and, said distal ends of all said first fingers connected by a cross member, said cross member disposed substantially parallel to said longitudinal axis;

(3) grasping said handle;

(4) using said first fingers to push the pile of coal and ash to a first area of the firebox;

(5) inserting said first fingers concave side up into the pile;

(6) removing said first fingers from the pile so that a portion of the coals reside on said concave side;

(7) in a supinating action rotating said handle about said longitudinal axis so that the portion of the coals are flipped to a second area of the firebox; and, (8) repeating steps (5) through (7) until the coals have been separated from the ash.

19. The method according to claim 18, further including:

in step (7), said rotation being at least about 30°.

20. The method according to claim 18, further including:

(9) as required, using said cross member to drag the coals from the pile.

21. The method according to claim 18, further including:

said tool for separating the coals from the ash further including:

a plurality of substantially parallel spaced-apart second fingers longitudinally disposed along said body at said second end;

said second fingers outwardly projecting from said body substantially perpendicular to said body;

said second fingers outwardly projecting from said body in a substantially opposite direction from said first fingers; and, said second fingers each having a different length, wherein said second finger closest to said first end of said body is the longest, and said second finger closest to said second end of said body is the shortest, and the length of each intervening second finger being selected so as to create a substantially tapered arrangement; and, (9) as required, using said second fingers in a raking motion to ensure that all the coals reside in the second area of the firebox.

* * * * *